US007482983B2

(12) United States Patent
Chang et al.

(10) Patent No.: US 7,482,983 B2
(45) Date of Patent: Jan. 27, 2009

(54) ELECTRONIC APPARATUS

(75) Inventors: Arthur Chang, Taipei (TW); Hung-Ta Huang, Taipei (TW)

(73) Assignee: ASUSTek Computer Inc., Taipei (TW)

( * ) Notice: Subject to any disclaimer, the term of this patent is extended or adjusted under 35 U.S.C. 154(b) by 253 days.

(21) Appl. No.: 11/492,175

(22) Filed: Jul. 25, 2006

(65) Prior Publication Data

US 2007/0057853 A1 Mar. 15, 2007

(30) Foreign Application Priority Data

Sep. 15, 2005 (TW) ..... 94131933 A

(51) Int. Cl.
*H01Q 1/24* (2006.01)

(52) U.S. Cl. ..... 343/702; 343/873

(58) Field of Classification Search ..... 343/702, 343/873, 872, 700 MS
See application file for complete search history.

(56) References Cited

U.S. PATENT DOCUMENTS 5,392,461 A * 2/1995 Yokoyama ..... 455/90.2
5,821,903 A * 10/1998 Williams ..... 343/702
6,642,907 B2 * 11/2003 Hamada et al. ..... 343/873
6,683,578 B2 * 1/2004 Nishikido et al. ..... 343/702
2005/0128149 A1 * 6/2005 Blom et al. ..... 343/702
2007/0247374 A1 * 10/2007 Nishikido et al. ..... 343/702

FOREIGN PATENT DOCUMENTS

JP 2000-138517 5/2000

* cited by examiner

*Primary Examiner*—Tho G Phan
(74) *Attorney, Agent, or Firm*—Rabin & Berdo, PC

(57) ABSTRACT

An electronic apparatus comprising a housing, a metallic antenna and a printed circuit board is provided. The housing comprises a metallic front casing and an insulating rear casing. The metallic front casing has a display panel and a number of buttons. The insulating rear casing is buckled to the metallic front casing. The insulating rear casing has an outer surface. The metallic antenna is disposed on part of the outer surface. The printed circuit board is disposed in the housing. The printed circuit board is electronically connected to the metallic antenna, the display panel and the buttons.

19 Claims, 3 Drawing Sheets

ELECTRONIC APPARATUS

This application claims the benefit of Taiwan application Serial No. 94131933, filed Sep. 15, 2005, the subject matter of which is incorporated herein by reference.

BACKGROUND OF THE INVENTION

1. Field of the Invention

The invention relates in general to an electronic apparatus, and more particularly to an electronic apparatus which disposes a metallic antenna on the housing to form a metal surface.

2. Description of the Related Art

A conventional mobile phone communicates with the station via an antenna. Antennas are categorized into external antenna and embedded antenna. In an embedded antenna, the antenna is embedded inside the housing. In an external antenna, the antenna is exposed outside the housing. However, when an antenna is projected from the housing and becomes an external antenna, the overall length of the electronic apparatus (such as a mobile phone) is prolonged. An electronic apparatus with an external antenna is not only inconvenient for the user to carry with but also against the features of lightweight, slimness, thinness, and compactness in the design of electronic apparatus.

When the antenna is disposed inside the housing and becomes an embedded antenna, if the housing is a metallic housing, the antenna will have poor quality in the transmission and reception of signals due to the shielding effect and will fail to maintain good communication with the station. In order to maintain the quality of the antenna in the transmission and reception of signals, the bottom casing of the housing can be made of plastics and designed as a plastic bottom casing, but the top casing is still made of metal to possess the metallic feature of the top casing. Under the above arrangement, the antenna will not be shielded by metallic substances when receiving or transmitting signals, thereby the quality in the transmission and reception of signals is maintained.

The bottom casing is typically made of plastics. Despite the top casing has a metallic appearance, the appearance of the overall housing is not thoroughly metallic, and the mobile phone does not possess a consistent metallic aesthetics. Therefore, consumers' expectation of a fashional appearance of the mobile phone can not be satisfied, and the practicality of the mobile phone is largely reduced. According to the aforementioned disclosure, a conventional mobile phone is unable to improve the appearance and its communication quality at the same time. Failing to break through the fixed type of appearance design, the conventional mobile phone will lose its competitiveness in the market.

The same matching problem of the material of antenna and the material of housing also occurs to any electronic apparatus having an antenna such as a personal digital assistant (PDA) or any electronic apparatus using global positioning system (GPS).

SUMMARY OF THE INVENTION

It is therefore an object of the invention to provide an electronic apparatus whose antenna is disposed on part of the outer surface of the housing, so that the thickness of the electronic apparatus is further reduced to accord with the current trend of thinning, compacting and reducing the weight of the electronic apparatus. That the antenna is not shielded by the housing not only provides excellent communication quality but also allows the remaining part of the outer surface of the housing to be electroplated with a metal layer. Therefore, the housing has a metallic color and emanates aesthetics of consistency, transcending the conventional restriction with respect to the material of the housing and further improving the competitiveness of the electronic apparatus.

The embodiment of the invention achieves the above-identified object by providing an electronic apparatus comprising a housing and a metallic antenna. The housing has an outer surface. The metallic antenna is disposed in the housing. The metallic antenna forms part of the outer surface.

The embodiment of the invention further achieves the above-identified object by providing an electronic apparatus comprising a housing, a metallic antenna and a printed circuit board (PCB). The housing comprises a metallic front casing and an insulating rear casing. The metallic front casing has a display panel and a number of buttons. The insulating rear casing is buckled to the metallic front casing. The insulating rear casing has an outer surface. The metallic antenna is disposed on part of the outer surface. The printed circuit board is disposed in the housing. The printed circuit board is electronically connected to the metallic antenna, the display panel and the buttons.

Other objects, features, and advantages of the invention will become apparent from the following detailed description of the preferred but non-limiting embodiments. The following description is made with reference to the accompanying drawings.

DETAILED DESCRIPTION OF THE INVENTION

An electronic apparatus comprising a housing and a metallic antenna is provided in the invention. The housing at least comprises an insulating rear casing. The insulating rear casing has an outer surface. The metallic antenna is disposed on part of the outer surface of the insulating rear casing to metalize the surface of the insulating rear casing. By disposing the metallic antenna outside the housing, the overall thickness of the electronic apparatus is reduced, and the electronic product is enabled to be thinner, lighter and compacter. A metallic layer which is insulated with the metallic antenna can be electroplated on other part of the outer surface of the insulating rear casing to give the housing of the electronic apparatus of the invention a consistent feature of metal and achieve the object of metalizing the overall housing. Thus, the appearance of the electronic apparatus becomes more attractive and competitive. Since the metallic antenna is disposed outside the insulating rear casing, the required time for assembling the electronic apparatus of the invention is reduced, and the production efficiency is improved.

Figure 1A:
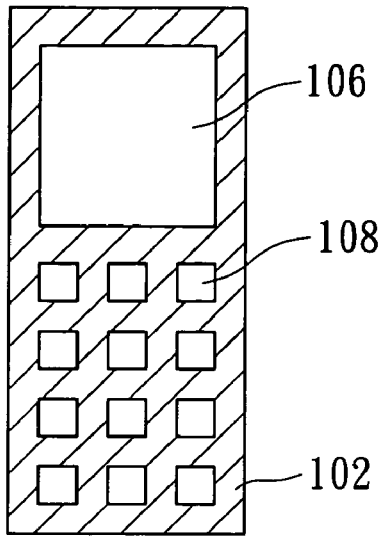
FIG. 1A is a top view of an electronic apparatus according to the preferred embodiment of the invention.
Figure 1B:
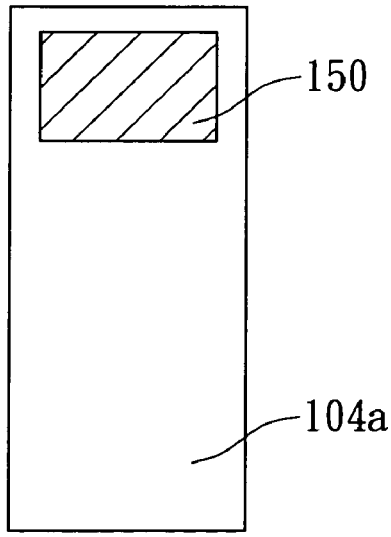
FIG. 1B is a back view of the electronic apparatus according to the preferred embodiment of the invention.
Figure 1C:
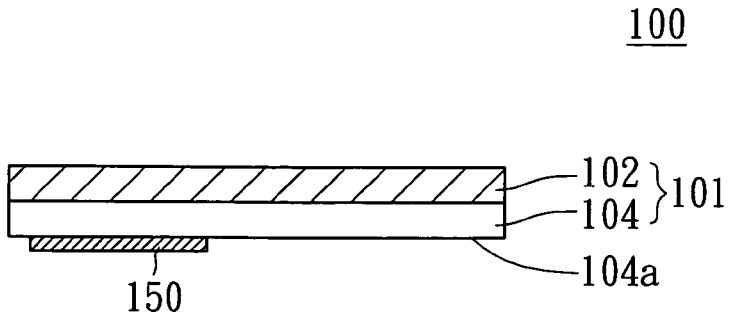
FIG. 1C is a side view of the electronic apparatus according to the preferred embodiment of the invention.
Figure 1D:
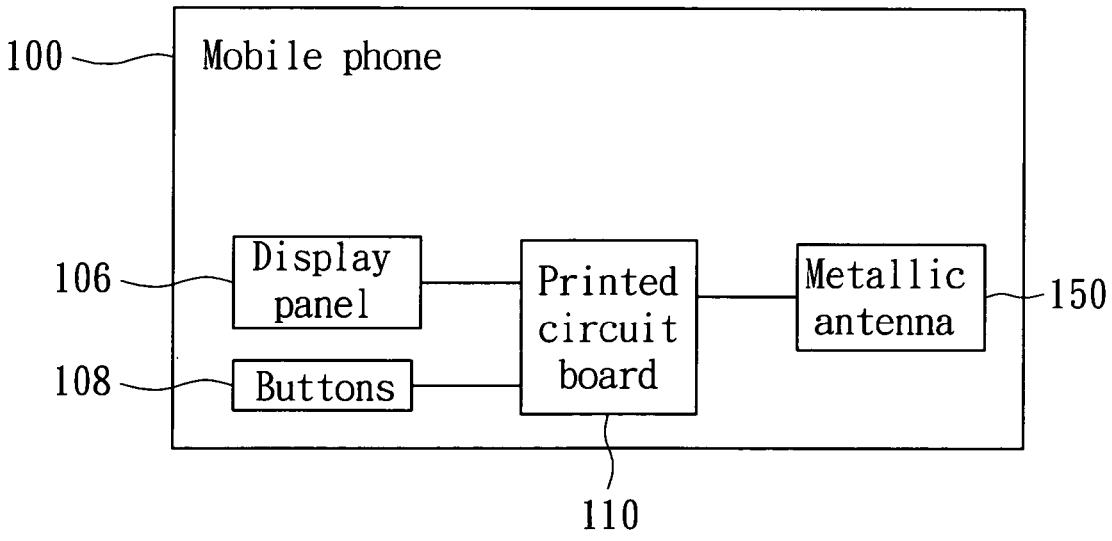
FIG. 1D is a circuit block diagram of the electronic apparatus according to the preferred embodiment of the invention.

Referring to FIGS. 1A-1D simultaneously. FIG. 1A is a top view of an electronic apparatus according to the preferred embodiment of the invention. FIG. 1B is a back view of the electronic apparatus according to the preferred embodiment of the invention. FIG. 1C is a side view of the electronic apparatus according to the preferred embodiment of the invention. FIG. 1D is a circuit block diagram of the electronic apparatus according to the preferred embodiment of the invention. In the present embodiment, the electronic apparatus 100 is exemplified by the structure of a mobile phone. In FIGS. 1A-1D, the electronic apparatus 100 comprises a housing 101, a metallic antenna 150 and a printed circuit board (PCB) 110.

The housing 101 comprises a metallic front casing 102 and an insulating rear casing 104. The metallic front casing 102 is able to be engaged with the insulating rear casing 104. Examples of the metallic front casing 102 include a display panel 106 and a number of buttons 108. The insulating rear casing 104 is buckled to the metallic front casing 102. The insulating rear casing 104 has an outer surface 104*a*. The material of the insulating rear casing 104 includes plastics, rubber or polymer.

In order to improve the transmission and reception of signal for the electronic apparatus 100 and enhance the metallization of the housing for the electronic apparatus 100, the present embodiment of the invention disposes the metallic antenna 150 on part of the outer surface 104*a* of the insulating rear casing 104. The metallic antenna 150 can be adhered to the electronic apparatus, or formed according to the in-mold decoration (IMD) technology or the double injection technology. In the present embodiment of the invention, the metallic antenna 150, which can be an antenna of any shapes, is exemplified by a squared structure. Since the metallic antenna 150 of the present embodiment of the invention is directly disposed on part of the outer surface 104*a* of the insulating rear casing 104, the electronic apparatus 100 of the present embodiment of the invention is thinner than the conventional mobile phone, and complies with the current trend of thinness, lightweight, slimness and compactness. Thus, the user would find it very handy and convenient when using the electronic apparatus 100 of the present embodiment of the invention. Moreover, the metallic antenna 150 of the present embodiment of the invention is disposed on the outer surface 104*a* of the insulating rear casing 104, and will not be shielded by metallic substances which impair the reception and transmission of signals. Therefore, the electronic apparatus 100 can maintain excellent quality in the transmission and reception of signals.

In the present embodiment of the invention, the printed circuit board 110 is disposed in the housing 101, and is preferably electronically connected to the display panel 106, the buttons 108 and the metallic antenna 150. The metallic antenna 150 is disposed on the outer surface 104*a* of the insulating rear casing 104. The insulating rear casing 104 preferably has a through hole for enabling the metallic antenna 150 to be electronically connected to the printed circuit board 110 disposed in the housing 101 via a conductive wire which passes through the through hole. Examples of the conductive wire include but are not limited to an elastomer or a probe.

As for how the metallic antenna 150 is coupled to the insulating rear casing 104 is elaborated below. Firstly, the mold of the metallic antenna and the mold of the insulating rear casing are placed into the double injection machine. Next, the molds are enclosed, pressed, ejected, cooled and opened in sequence. After that, the metallic antenna and the insulating rear casing are removed from their respective molds, and the metallic antenna 150 is disposed on the insulating rear casing 104. Besides, the metallic antenna 150 and the insulating rear casing 104 can be coupled according to other technologies. For example, a positioning structure can be formed on the insulating rear casing 104 or the metallic antenna 150, and the two elements can be adhered together by using an adhesive such as a double-sided tape.

Figure 2:
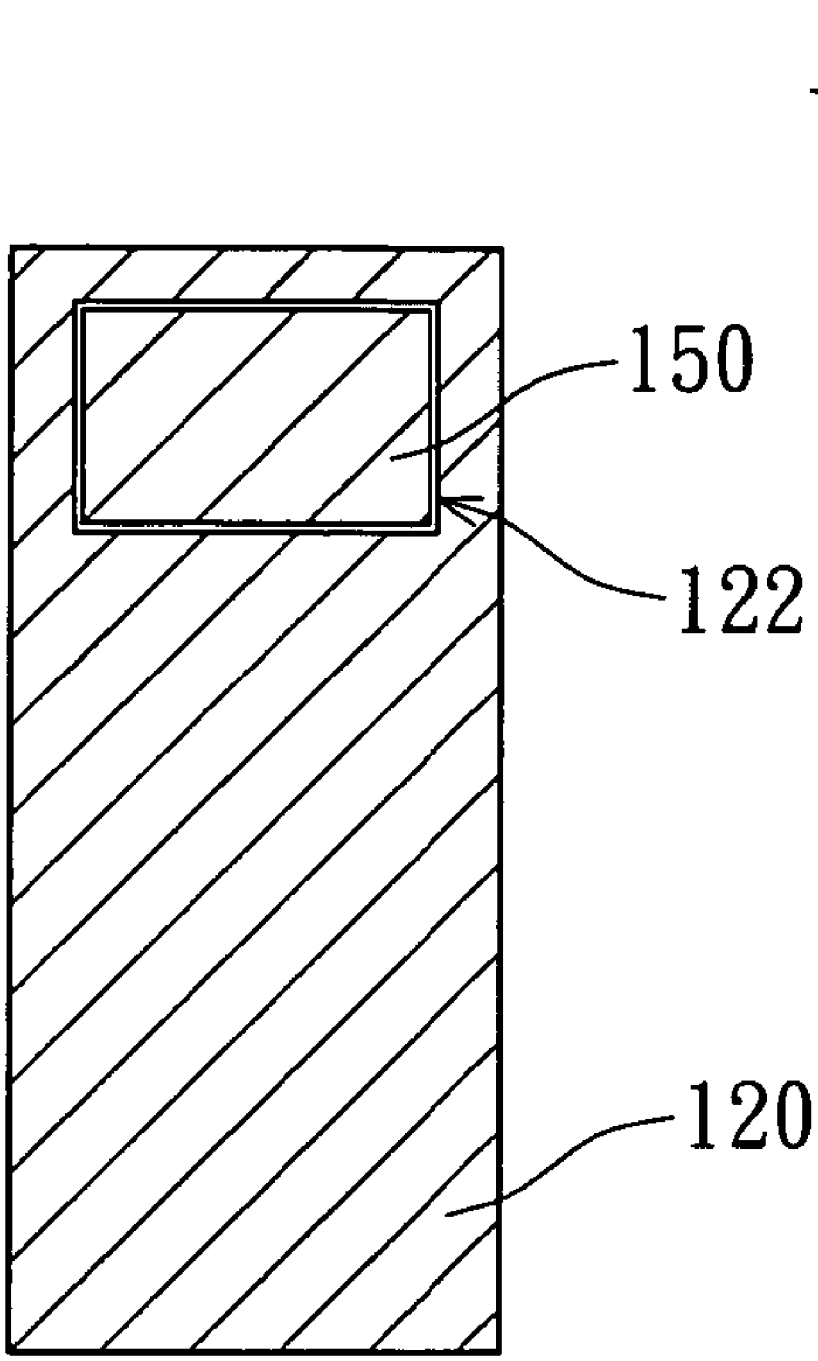
FIG. 2 is a back view of an electronic apparatus having a first metallic layer according to the invention.

Referring to FIG. 2, a back view of an electronic apparatus having a first metallic layer according to the invention is shown. Since the insulating rear casing 104 does not shield the metallic antenna 150 nor affects its quality in the transmission and reception of signals, the electronic apparatus 100 of the present embodiment of the invention can further comprises a first metallic layer 120 disposed on the other part of the outer surface 104*a*. The first metallic layer 120 preferably covers the other part of the outer surface 104*a* of the insulating rear casing 104 for enabling the insulating rear casing 104 to have a metallic color and feature in response to the metallic front casing 102. Thus, the electronic apparatus 100 can have both attractive appearance and quality communication at the same time, and the overall housing is metalized, giving the electronic apparatus 100 a metal feature.

The first metallic layer 120 can be insulated with the metallic antenna 150. For example, by creating a gap 122 between the metallic antenna 150 and the first metallic layer 120, the metallic antenna 150 is insulated with the first metallic layer 120. The first metallic layer 120 can be formed by forming a second metallic layer adjacent to the metallic antenna 150 first, and trimming the edge of the second metallic layer adjacent to the metallic antenna 150 next by using a laser. Besides, an insulated paint, such as transparent paint, semi-transparent paint, silver paint or other metallic colored paint, can be disposed in the gap 122.

However, any one who is skilled in the technology of the present embodiment of the invention will understand that the technology of the present embodiment of the invention is not limited thereto. For example, the aforementioned electronic apparatus is not limited to a mobile phone, and can be a personal digital assistant (PDA) or an electronic apparatus using the global positioning system (GPS) instead. Any electronic apparatus having an antenna is within the scope of protection of the invention.

Besides, the housing of the electronic apparatus of the invention is not limited to the assembly of the metallic front casing and the insulating rear casing. The material of the top casing of the housing and the material of the bottom casing of the housing can both be plastics or other insulated materials. Part of the outer surface of the bottom casing has a metallic antenna disposed thereon, while the other part of the outer surface of the housing, including the part of the surface of the top casing and the part of the surface of the bottom casing not covered by the metallic antenna, can be painted with a metallic or metallic colored paint which is insulated with the metallic antenna, so as to metalize the overall housing.

According to the electronic apparatus having an antenna disclosed in above embodiment of the invention, the antenna is disposed on part of the outer surface of the insulating rear casing, so that the electronic apparatus whose size is further reduced and whose portability is more convenient complies with the track of fashion. Moreover, since the antenna of the invention is shielded by metallic substances and the reception and transmission of signals are not impaired, the electronic apparatus of the present embodiment of the invention maintains excellent communication quality. Furthermore, the electronic apparatus of the present embodiment of the invention can form a metallic layer on the other part of the insulating rear casing, so that the insulating rear casing looked metallic colored and possesses a feature of metal when coupled with the metallic front casing. Consequently, the electronic apparatus of the present embodiment of the invention, which is slim and compact in terms of size and has an attractive appearance and excellent communication quality, is very competitive in the market.

To summarize, the invention reduces the thickness of the body of the electronic apparatus, and makes the product thinner, lighter and compacter. In addition, by metalizing the surface of the electronic apparatus, the invention enables the appearance of the electronic apparatus to be more attractive. Moreover, the invention reduces the assembly time for the electronic apparatus and increases the production efficiency.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electronic apparatus, comprising:

a housing having an outer surface;

a metallic antenna disposed in the housing, wherein the metallic antenna forms part of the outer surface;

a first metal layer formed on the other part of the outer surface and insulated with the metallic antenna.

2. The electronic apparatus according to claim 1, wherein there is a gap between the metallic antenna and the first metal layer.

3. The electronic apparatus according to claim 2, further comprising an insulated paint disposed in the gap.

4. The electronic apparatus according to claim 3, wherein the insulated paint is transparent, semi-transparent, silver colored or metal colored.

5. The electronic apparatus according to claim 1, wherein the first metallic layer is formed by trimming the edge of a second metallic layer adjacent to the metallic antenna by using a laser.

6. The electronic apparatus according to claim 1, further comprises a printed circuit board (PCB) disposed in the housing and electronically connected to the metallic antenna.

7. The electronic apparatus according to claim 6, wherein the housing further comprises a metallic front casing engaged with the insulating rear casing to retain the printed circuit board.

8. The electronic apparatus according to claim 7, further comprising a display panel disposed on the metallic front casing and electronically connected to the printed circuit board.

9. The electronic apparatus according to claim 7, further comprising a button disposed on the metallic front casing and electronically connected to the printed circuit board.

10. An electronic apparatus comprising:

a housing having an outer surface;

a metallic antenna disposed in the housing, wherein the metallic antenna forms part of the outer surface; and a printed circuit board disposed in the housing and electronically connected to the metallic antenna;

wherein the housing further comprises an insulating rear casing having the outer surface and a through hole, and the metallic antenna is electronically connected to the printed circuit board via a conductive wire passing through the through hole.

11. The electronic apparatus according to claim 10, wherein the conductive wire is an elastomer or a probe.

12. An electronic apparatus, comprising:

a housing, comprising:

a metallic front casing having a display panel and a plurality of buttons; and an insulating rear casing having an outer surface buckled to the metallic front casing;

a metallic antenna disposed on part of the outer surface; and a printed circuit board (PCB) disposed in the housing and electronically connected to the metallic antenna, the display panel and the buttons.

13. The electronic apparatus according to claim 12, further comprising a first metallic layer formed on the other part of the outer surface and insulated with the metallic antenna.

14. The electronic apparatus according to claim 13, wherein there is a gap between the metallic antenna and the first metal layer.

15. The electronic apparatus according to claim 14, further comprising an insulated paint disposed in the gap.

16. The electronic apparatus according to claim 15, wherein the insulated paint is transparent, semi-transparent, silver-like colored or metal-like colored.

17. The electronic apparatus according to claim 13, wherein the first metallic layer is formed by trimming the edge of a second metallic layer adjacent to the metallic antenna by using a laser.

18. The electronic apparatus according to claim 12, wherein the insulating rear casing has a through hole, and the metallic antenna is electronically connected to the printed circuit board via a conductive wire passing through the through hole.

19. The electronic apparatus according to claim 18, wherein the conductive wire is an elastomer or a probe.

* * * * *